US005238534A

United States Patent [19]

Manning et al.

[11] Patent Number: 5,238,534

[45] Date of Patent: Aug. 24, 1993

[54] WETLAID NONWOVENS ON HIGH SPEED MACHINES

[75] Inventors: James H. Manning, Appleton, Wis.; Irwin M. Hutten, Atlanta, Ga.

[73] Assignee: James River Corporation of Virginia, Richmond, Va.

[21] Appl. No.: 825,136

[22] Filed: Jan. 24, 1992

[51] Int. Cl.[5] ..... D21H 13/10

[52] U.S. Cl. ..... 162/146; 162/157.2; 162/164.6; 162/177; 162/202

[58] Field of Search ..... 162/146, 157.2, 164.6, 162/177, 202

[56] References Cited

U.S. PATENT DOCUMENTS

| | | | |
|---|---|---|---|
| 3,716,449 | 3/1973 | Gatward et al. | 162/101 |
| 3,798,122 | 3/1974 | Appel | 162/101 |
| 3,837,999 | 9/1974 | Chung | 162/101 |
| 3,871,952 | 3/1975 | Robertson | 162/101 |
| 3,947,315 | 3/1976 | Smith | 162/101 |
| 4,822,452 | 4/1989 | Tse et al. | 162/146 |
| 4,925,528 | 5/1990 | Tse et al. | 162/146 |

*Primary Examiner*—Peter Chin

[57] ABSTRACT

A method for the production of a fibrous web having textile length fibers wherein a fiber furnish is formed by dispersion of the fibers in an unfoamed carrier medium of water and an associative thickener of ethylene oxide base urethane block copolymers or hydroxyethylcellulose ethers having a $C_{10}$ to $C_{24}$ alkyl side chain in an amount within the range of from about 1 to about 150 pounds of thickener per ton of dry fiber and including an anionic viscosity modifier in the range of 10 to 500 ppm. The furnish having a consistency in the range of 0.05 to 0.2 weight percent fibers is supplied to a high speed papermaking machine for forming a fibrous web. The textile length fibers may be polyester fibers being 1.5 denier and ¾ inches. The high speed papermaking machine may be a twin-wire papermaking machine or a suction breast roll papermaking machine or a crescent former papermaking machine.

15 Claims, 3 Drawing Sheets

WETLAID NONWOVENS ON HIGH SPEED MACHINES

BACKGROUND OF THE INVENTION

1. Field of the Invention

The present invention is directed to a method for producing a fibrous web including textile length fibers wherein a thickener is used to disperse long synthetic fibers to produce a consistency in the range of 0.1 to 0.16 weight percent fibers thereby permitting the furnish to be supplied to a high speed papermaking machine for forming a fibrous web.

2. Description of Background Art

Hithertofore, a fibrous web containing textile length fibers has been formed by wet forming the web on an inclined wire papermaking machine. One method forms a uniform web from an unfoamed dispersion of staple length natural or synthetic fibers in water containing a small amount of polymeric surfactant, wherein some of the surfactant is known as associative thickeners. In this method, polymeric surfactant of the type known as associative thickener consisting essentially of an ethylene oxide based urethane block copolymer having alternating blocks of polyethylene glycol and polyurethane as dispersants is used in water as the carrier for natural and synthetic fibers. Other polymeric surfactants known as associative thickeners consisting essentially of hydroxyethylcellulose having a long aliphatic side chain as the dispersant and thickener for natural and synthetic cellulose fiber is used in a water carrier.

In addition, methods for forming a nonwoven fibrous web containing textile length fibers, for example, synthetic fibers having a length to diameter ratio in the range of from about 300 to 3,000, in a wet papermaking process are known in the art. Generally, a viscous aqueous carrier comprising a dispersant and thickener is required for good dispersion of long thin flexible synthetic fibers, for example, 1.5 denier by ¾ inch (0.019 mm) fibers. The long thin synthetic fibers tend to tangle and form flocs or knits in the finished nonwoven fabric when formed from an aqueous dispersion suitable for wet laying papermaking fibers on a papermaking machine.

Methods of forming a fibrous web containing textile length fibers by utilizing a wetlaid process on a conventional papermaking machine are disclosed in U.S. Pat. Nos. 4,822,452 and 4,925,528 which are owned by the same Assignee as the present invention. U.S. Pat. Nos. 4,822,452 and 4,925,528 are hereby incorporated by reference.

SUMMARY OF THE PRESENT INVENTION

The present invention is directed to a method of production of a fibrous web including textile length fibers wherein a fiber furnish is formed by dispersion of the fibers in an unfoamed carrier medium consisting essentially of water and an associative thickener selected from the group consisting of ethylene oxide based urethane block copolymers and hydroxyethylcellulose ethers having a $C_{10}$ to $C_{24}$ alkyl side chain in an amount within the range of from about 1 to 150 pounds of thickener per ton of dry fiber. The unfoamed fiber furnish having a consistency in the range of approximately 0.05 to 0.2 weight percent fibers is supplied to a high speed papermaking machine for forming a fibrous web. The textile length fibers may be polyester fibers being 1.5 denier and ¾ inch (0.019 mm). The high speed papermaking machine may be a twin-wire, crescent former or a suction breast roll papermaking machine.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
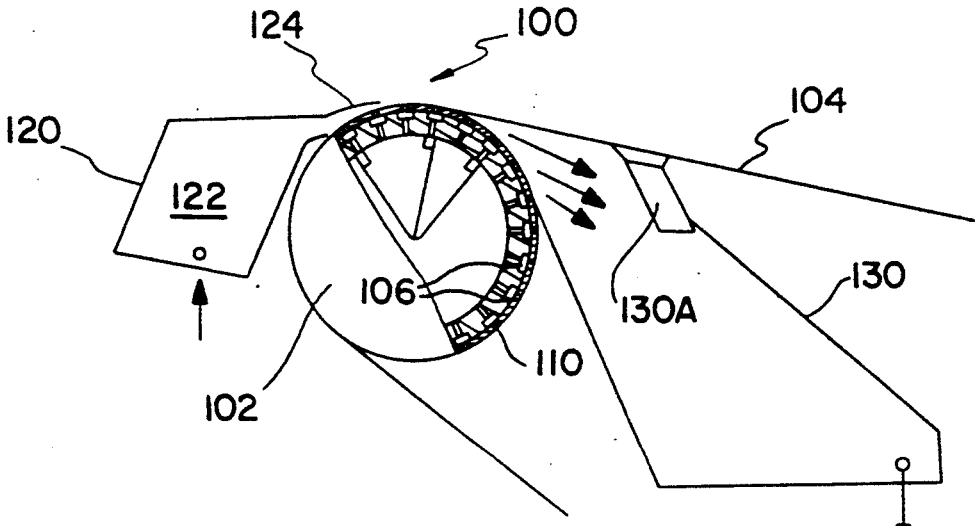
FIG. 1 is schematic view illustrating a suction breast roll papermaking machine which may be utilized together with the method of the present invention.

The term "polymeric surfactant" is defined as a molecule which contained a plurality, two or more, of both hydrophilic moieties and hydrophobic moieties. This definition is derived from that of a simple surfactant, surface reactant agent, comprising a hydrophilic moiety and a hydrophobic moiety. The difference in the hydrophilic and the hydrophobic portions of the polymeric surfactant molecules control the propensity of these molecules to arrange themselves in preferential molecular orientations at the interface between dissimilar substances. In the case of the present invention, the polymer surfactants attach themselves to the surfaces of fibers at their interface with water as the suspending medium.

The key molecular feature is that the molecules contain both hydrophilic portions and hydrophobic portions. The key distinction from simple surfactants is that these molecules would contain a multiplicity, two or more, of these types of groups. The type of groups, as well as the relative positions of these ranges within specific molecules, can include a broad range of chemical moieties and distributions.

The associative thickener molecules have a multiplicity of hydrophobic and hydrophilic portions or "blocks" which form networks in an aqueous carrier medium, the exact nature of which is dependent upon the molecular shape and composition, as well as the nature of the solvent. The formation of networks provides changes in the rheology of the solution that result in increases in viscosity; hence, the term "associative thickeners." Associative thickeners have been used in the paint industry for changing the rheological properties of paint formulations.

The present invention provides an improved method for forming fibrous webs from a water furnish containing textile length fibers which includes polymeric surfactant associative thickeners in the water making up the fiber furnish. Such polymer surfactant associative thickeners have being developed primarily for use in the formation of latex paints. The urethane block copolymers are described by E. J. Schaller and P. J. Rogers-Moses, Resin Review, Vol. XXXVI, No. 2, pages 19–26, which are incorporated herein by reference. The hydrophobically-modified hydroxyethylcellulose associative thickeners are described by K. G. Shaw and D. P. Liepold, Journal of Coatings Technology 57, N. 727, pages 63–72 (August, 1985), incorporated herein by reference. In latex paints, such associative thickeners are used to give the formulation certain desirable properties, for example, enough viscosity to resist running and over-spreading; spatter resistance; and improved leveling properties. The use of these associative thickeners in the manufacture of a water laid fabric web is disclosed in U.S. Pat. No. 4,822,452, which is owned by the same Assignee as the present invention.

A dispersion of fibers in water is made up with a small amount of an associative thickener which acts as both a surfactant or dispersant and as a thickener, slightly increasing the viscosity of the water carrier medium and acting as a lubricant for the fibers. One class of polymeric surfactant associative thickeners preferred in the process of the invention comprises relatively low, 10,000 to 200,000, molecular weight ethylene oxide based urethane block copolymers and is disclosed in U.S. Pat. Nos. 4,079,028 and 4,155,892 which are incorporated herein by reference. The associative thickeners are particularly effective when the fiber furnish contains 10 percent or more staple length hydrophobic fibers. Commercial formulations of these copolymers are sold by Rohm and Haas, Philadelphia, Pa., under the trade names Acrysol RM-825 and Acrysol Rheology Modifiers QR-708, QR-735 and QR-1001 which comprise the urethane block copolymers in different carrier fluids. Acrysol RM-825 is a 25 percent solids grade of polymer in a mixture of 25 percent butyl carbitol, a diethylene glycol monobutyl ether, and 75 percent water. Acrysol Rheology Modifier QR-708, a 35 percent solids grade in a mixture of 60 percent propylene glycol and 40 percent water, has been found to produce excellent results in test runs as reported in Example 1 below. Similar copolymers in this class including those marketed by Union Carbide Corporation, Danbury, Conn., under the trade names SCT-200 and SCT-275 are useful in the process of the invention. These copolymers are polyurethane oxide/urethane/hydrophobe copolymers. Another associative thickener is marketed by Hi-Tek Polymers, Jeffersontown, Ky., and has been described as a hydrophobically modified polyethylene oxide.

A number of additional associative thickeners and examples of utilizing the associative thickeners with a furnish are set forth in U.S. Pat. Nos. 4,822,452 and 4,925,528. As indicated hereinabove, the disclosure of both U.S. Pat. Nos. 4,822,452 and 4,925,528 are hereby incorporated by reference.

The present invention utilizes the associative thickeners in a furnish having approximately 75 percent Marathon Softwood Kraft and 25 percent polyester fiber 1.5 denier ¾ inch (0.019 mm) long. The furnish is supplied to a headbox of a suction breast roll papermaking machine or a twin-wire papermaking machine. This furnish can produce a 20 pound (9.09 kg) sheet formed at 1,500 feet per minute (457.2 meters per minute).

On a suction breast roll machine, a furnish consisting of 75 percent Northern Softwood Kraft (Marathon) and 25 percent PET (polyester) fiber 1.5 denier, ¾ inch (0.019 mm) long was utilized. A 20 pound (9.09 kg) sheet was formed at a machine speed of 1,500 feet per minute (457.2 meters per minute). The creped version of the sheet coming off the Yankee dryer exhibited very interesting nonwoven softness properties.

A furnish of 75 percent Northern Softwood Kraft and 25 percent PET fiber, 1.5 denier, ¾ inch (0.019 mm) was utilized as the furnish in a headbox with a variable water jet to wire speed velocity ratio and slice opening in an effort to improve the grain ratio (MD:CD tensile ratio) and formation. It was noted that formation did improve with a larger slice opening. Grain ratio was optimized at 2.5:1 at jet ratio (water:wire) slightly greater than 1:1.

Utilizing a furnish with a shorter polyester fiber, for example, ½ inch (0.0127 mm), so that the 25 percent PET was 1.5 denier and ½ inch (0.0127 mm) with the remaining of the furnish being 75 percent Marathon, impressive improvements in the formation of a web of paper was produced at speeds up to 2,000 feet per minute (609.6 meters per minute). Continuation of the headbox variable study achieved a grain ratio of 2:1 at a jet:wire ratio of 1.25:1.

In one example, the polyester component was prepared in a first pulper and the wood pulp component was prepared in a second pulper. The two components, fed from separate machine chests, were blended in line on the way to the headbox. The ratio of the two components was predetermined as desired. The purpose of this experiment was to determine the highest polyester content web that could be produced on a suction breast roll machine. The polyester component was a 50—50 mixture of 1.5 denier ½ inch (0.0127 mm) and 1.2 denier, ¼ inch (0.006 mm) fiber. The wood pulp component was Northern Softwood Kraft (Marathon). The PET:Pulp ratios run during the experiment were as follows:

15 PET to 85 Marathon
25 PET to 75 Marathon
24 PET to 56 Marathon
53 PET to 47 Marathon
75 PET to 25 Marathon The machine speed was 1,500 feet per minute (457.2 meters per minute). At all levels of PET, the formation was very good. Grain ratios as low as 2:1 were achieved. Property changes with increasing PET level were as expected, namely, increased bulk and softness, lower dry strength. At each level of PET a roll of creped and uncreped substrate were produced. This is true except at the 75:25 PET:Pulp level. At this level the sheet was too weak to be wound up on the reel regardless of whether the sheet was creped or not.

FIG. 1 is schematic view illustrating a suction breast roller paper machine 100. The suction breast paper machine 100 includes a suction roll 102 with a wire 104 operatively positioned to travel therearound. A plurality of low pressure zones 106 are operatively connected to a central low pressure zone for providing a suction around the outer circumferential surface 110 of the suction roller 102. A hydraulic headbox 120 is provided for containing a furnish 122. The furnish 122 is pressurized and exits from the splice 124 to be discharged onto the suction breast roller papermaking machine 100. After the furnish is discharged along the width of the wire 104, some of the water within the furnish is discharged through the low pressure zones 106 to the saveall 130. A foil 130A is positioned to ensure removal of liquid from the underside of the wire 104 as the wire 104 carries the fibrous web away from the breast roll for subsequent treatment.

Figure 2:
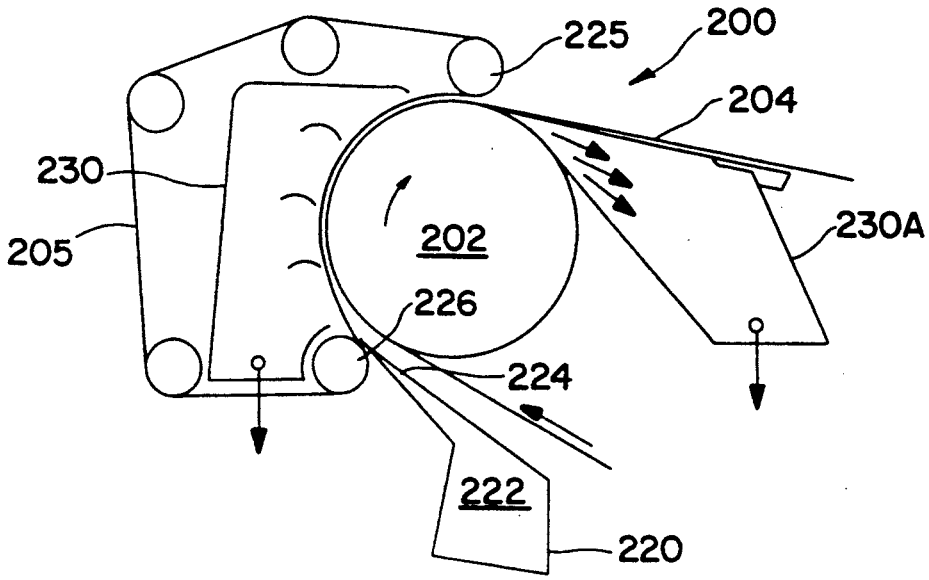
FIG. 2 is a schematic view of a twin-wire papermaking machine which may be utilized together with the method of the present invention.

FIG. 2 is a schematic view of a twin-wire papermaking machine 200. The twin-wire papermaking machine 200 includes a roll 202 with a wire 204 operatively positioned therearound. A second wire 205 is disposed to travel adjacent to the wire 204 during a portion of the circumferential surface 210 of the roll 202. A return roll 225 is disposed for permitting the second wire 205 to travel in a continuous path to reenter the twin-wire papermaking machine 200. A headbox 220 is provided for supplying a furnish 222 to the twin-wire papermaking machine 200. A slice opening 224 discharges a jet 226 of furnish into the spacing between the first wire 204 and the second wire 205. A saveall 230 is provided for removing a predetermined quantity of liquid from the web as the web passes over the roll 202 and between the twin wires 204 and 205. A saveall 230A is positioned to receive liquid thrown from beneath the curved section of the wire 204.

Figure 4:
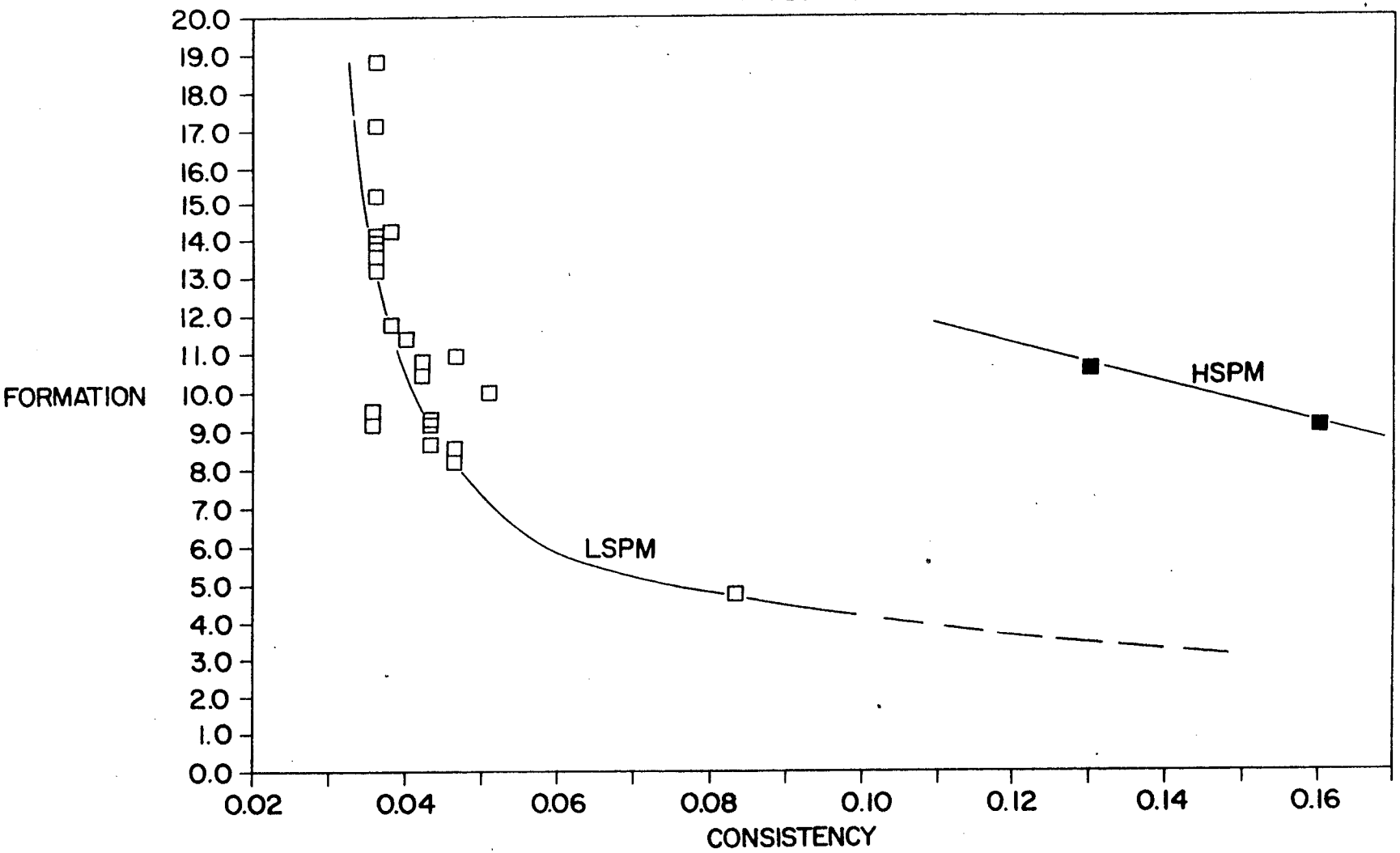
FIG. 4 is a Table showing the formation versus consistency of a low speed inclined wire papermaking machine according to the prior art and a high speed papermaking machine according to the present invention.

FIG. 4 is a chart illustrating the formation as measured by an MK Instrument manufactured by MK Systems, Inc. of Danvers, Mass., versus consistency of furnish supplied to a low speed papermaking machine according to the prior art and furnish supplied to a high speed papermaking machine according to the present invention. As illustrated in FIG. 4, the normal consistency of furnish supplied to a low speed inclined wire papermaking machine is in the range of 0.02 to 0.05. The curve provided in FIG. 4 illustrates that the formation is satisfactory when the furnish is in the range of 0.03 to 0.05. As the consistency increases to be greater than 0.05, the formation is at a low level. The present invention has achieved formation of a web by utilizing a high speed papermaking machine, such as a twin-wire, suction breast roller or crescent former machine with a furnish having a consistency in the range of 0.1 to 0.16. Improved results are achieved by utilizing a furnish having a consistency of 0.1 to 0.16 together with a high speed papermaking machine. In the present invention, formation of the sheet is in the range of 9.0 to 12.0. This produces a good formation with a consistency acceptable for a high speed papermaking machine.

In making up the fiber dispersion containing the staple length fibers, low shear agitation, as provided by a non-stapling agitator is preferred to avoid tangling of the long fibers. A small amount of a conventional polymer thickener, also referred to as a viscosity modifier, may be added to the dispersion in the range of 10 to 500 ppm, preferably in the range of 25 to 120 ppm, to more precisely control drainage of water from the wire during web formation. While a number of anionic polymers may be used for this purpose, the anionic polymer sold under the trade name Hydraid 7300-C by Calgon, Inc., Pittsburgh, Pa, is particularly effective at concentrations of the order of 100 ppm. A defoamer, e.g. the product sold under the trade name DF-122 by Diamond Shamrock Company may be added, if required, during the preparation of the fiber furnish to eliminate foam formation in the dispersion.

However, if one uses bicomponent fibers, then a sheet of 100% synthetic fibers is possible. A crescent former papermaking machine is especially suitable for making a 100% fiber web or sheet.

EXAMPLE 1

100% Synthetic Fiber Web

A web consisting of 100% Hoechst Celanese Celbond K56, 2d×10 mm fiber was produced on a pilot scale paper machine. Celbond K56 fibers are 2d×10 mm proprietary bicomponent fibers having a polyolefin sheath and a concentric polyester (polyethylene terephthalate) core. The fibers were dispersed in a batch process in a pulper containing 2000 gallons (7570 liters) 100° F. (37.8° C.) water, 2.9 pounds (1.32 kg) Rohm and Haas QR-708, 60 gallons (227 liters) of an 0.6% solution of Calgon Hydraid 7300C, and 300 pounds (136 kg) of fiber. A second pulper was prepared in the same manner and the contents of both pulpers were combined in the machine chest with a final volume of 7000 gallons (26,495 liters).

Figure 3:
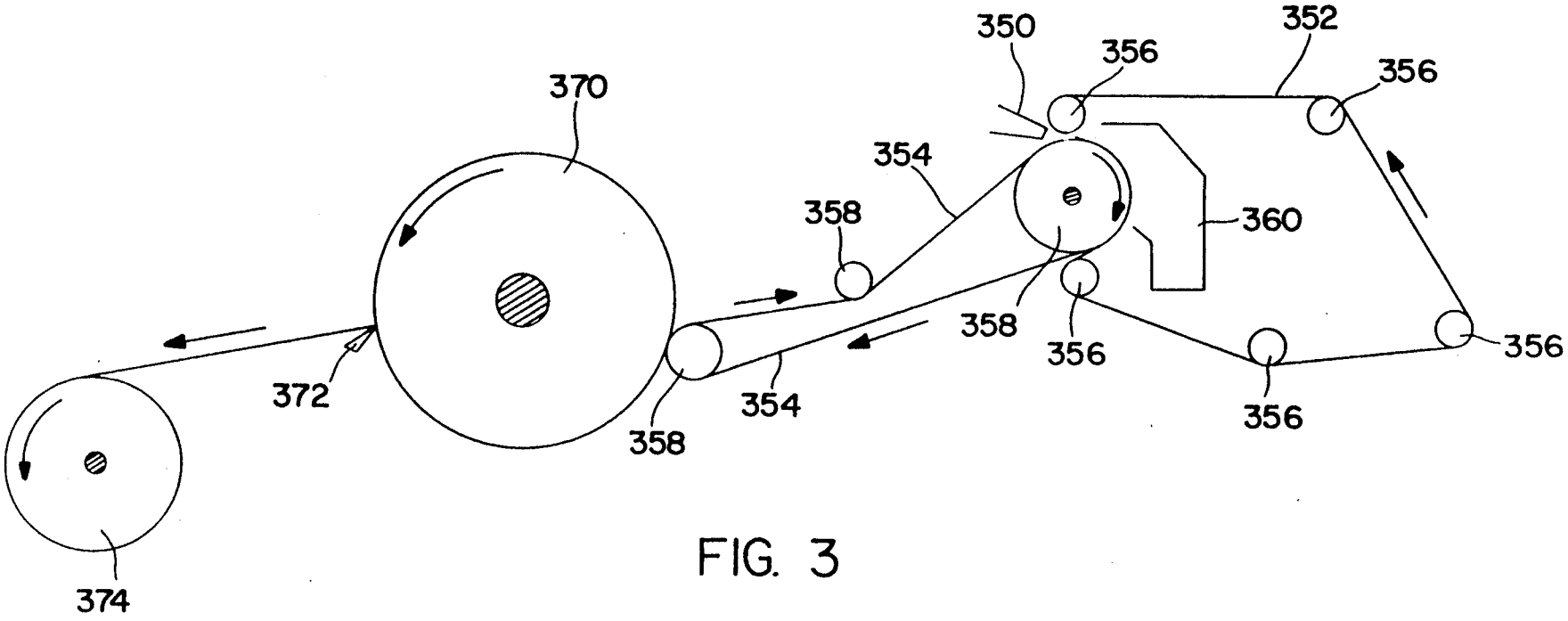
FIG. 3 is a schematic view of a crescent former papermaking machine which may be utilized together with the method of the present invention.

The fiber slurry was formed into a web by use of a Beloit Crescent Former which is schematically shown in FIG. 3. This crescent former is not a twin-wire gap former because a felt and wire are used. The fiber slurry is distributed (squirted) by a nozzle 350 of a pressurized headbox between a forming wire 352 and a felt 354 which are traveling at 3000 fpm (914 mpm). The wire 352 is supported by a plurality of guide rolls 356 and the felt 354 is supported by guide rolls 358. Most of the water is removed through the wire and is collected in a saveall 360. The consolidated fibrous web is retained on the felt which carries the fibrous web to a Yankee dryer. As the web passed over a 12 foot diameter Yankee dryer 370 heated to 265° F. (129° C.), the fiber sheath softened, flowed, and bounded the fibers to one another.

By pulling the web off the Yankee dryer without creping and by having the reel run the same 3,000 fpm (914 mpm), nonwoven fabric having 100% bicomponent fiber was made. It has the properties and appearance of a spunbond nonwoven.

TABLE I

COMPARISON OF PHYSICAL PROPERTIES OF PRESENT INVENTION WET LAID NONWOVEN VS. SPUNBOND NONWOVEN

| | | SPUNBOND NONWOVEN | PRESENT INVENTION HSPM 2639-1 0% Draw |
|---|---|---|---|
| Basis Weight (lb/3000 ft$^2$) | | 10.54 | 7.3 |
| Caliper (mils) | | 8.6 | 3.7 |
| Air Permeability (cfm) | | 925.0 | *** |
| Dry Strip Tensile (g/3 inch) | MD | 4492.0 | 2,159.0 |
| | CD | 3640.0 | 1,424.0 |
| Elongation (%) | MD | 31.6 | 15.0 |
| | CD | 36.6 | 16.0 |
| Elmendorf Tear (g) | MD | 691.0 | 64.0 |
| | CD | ** | 99.0 |
| Dry Mullen (psi) | | 14.1 | 5.1 |

**Would not tear on CD.
***Too high to measure.
Furnish
HSPM 2639-1
100% Hoechst-Celanese Celbond K-56, PE/PET (sheath/core), 2 d × 10 mm The present invention achieves the use of long synthetic fibers in the range of 1.5 denier and ¾ inch (0.019 mm) fibers which may consist of up to 100 percent of the furnish which may be provided to a headbox of a twin-wire machine, a suction breast roll or a crescent former machine having a high speed and provide the fibers at a consistency of 0.05–0.2 percent. The machines can be run at speeds up to 5,000 feet per minute (1524 meters per minute). Improved results are achieved by the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for the production of a fibrous web including textile length fibers comprising the following steps:

forming a fiber furnish by dispersion of said fibers in an unfoamed carrier medium consisting essentially of water and an associative thickener selected from the group consisting of ethylene oxide base urethane block copolymers and hydroxyethylcellulose ethers having a $C_{10}$ to $C_{24}$ alkyl side chain in an amount within the range of from about 1 to about 150 pounds of thickener per ton of dry fiber and including an anionic viscosity modifier in the range of 10 to 500 ppm;

supplying said unfoamed fiber furnish having a consistency in the range of approximately 0.10 to 0.16 weight percent fibers to a high speed papermaking machine having a speed in the range of about 1,500 fpm (457.2 mpm) to 5,00 fpm (1,524 mpm) for forming a fibrous web.

2. The method of production of a fibrous web according to claim 1, wherein said textile length fibers are selected from the group consisting of polyester, nylon, acrylic, polyethylene, polypropylene, and lycra fibers having a length to diameter ratio of 300 to 3000.

3. The method for production of a fibrous web according to claim 1, wherein said high speed papermaking machine is a twin-wire papermaking machine.

4. The method for production of a fibrous web according to claim 1, wherein said high speed papermaking machine is a suction breast roll papermaking machine.

5. The method for production of a fibrous web according to claim wherein said high speed papermaking machine is a crescent former papermaking machine.

6. The method for production of a fibrous web according to claim 2, wherein the furnish supplied to the high speed papermaking machine includes fibers selected from the group consisting of polyester, nylon, acrylic, polyethylene, polypropylene, and lycra fibers in the range of 15 to 100 percent and wood pulp fiber in the range of 85 to 0 percent.

7. The method for production of a fibrous web according to claim 3, wherein the twin-wire papermaking machine operates at speeds in excess of 1500 feet per minute (457.2 meters per minute).

8. The method for production of a fibrous web according to claim 1, wherein said anionic viscosity modifier is in the range of 25–120 ppm.

9. A method for the production of a fibrous web from a mixture of synthetic fibers and softwood kraft comprising the following steps:

forming a fiber furnish by dispersing the fibers in an aqueous carrier in the presence of a polymeric surfactant associative thickener containing two or more of both hydrophobic and hydrophilic groupings per molecule and having a molecular weight in the range of from about 10,000 to about 400,000 in an amount within the range of from about 1 to about 150 pounds of polymeric surfactant per pound of dry fiber and including an anionic viscosity modifier in the range of 10 to 500 ppm;

supplying said fiber furnish having a consistency in the range of approximately 0.10 to 0.16 weight percent fibers to a high speed papermaking machine having a speed in the range of about 1,500 fpm (457.2 mpm) to 5,000 fpm (1,524 mpm) for forming a fibrous web.

10. The method for production of a fibrous web according to claim 9, wherein said textile length fibers are selected from the group consisting of polyester, nylon, acrylic, polyethylene, polypropylene, and lycra fibers having a length to diameter ratio of 300 to 3000.

11. The method for production of a fibrous web according to claim 9, wherein said high speed papermaking machine is a twin-wire papermaking machine.

12. The method for production of a fibrous web according to claim 9, wherein said high speed papermaking machine is a suction breast roll papermaking machine.

13. The method for production of a fibrous web according to claim 9, wherein said high speed papermaking machine is a crescent former papermaking machine.

14. The method for production of a fibrous web according to claim 10, wherein the furnish supplied to the high speed papermaking machine includes fibers selected from the group consisting of polyester, nylon acrylic, polyethylene, polypropylene, and lycra fibers in the range of 15 to 100 percent and wood pulp fibers in the range of 85 to 0 percent.

15. The method for production of a fibrous web according to claim 9, wherein said anionic viscosity modifier is in the range of 25–120 ppm.

* * * * *

UNITED STATES PATENT AND TRADEMARK OFFICE

CERTIFICATE OF CORRECTION

PATENT NO. : 5,238,534

DATED : August 24, 1993

INVENTOR(S) : James H. Manning and Irwin M. Hutten

It is certified that error appears in the above-indentified patent and that said Letters Patent is hereby corrected as shown below:

Column 7, line 37, claim 2, change "lycra" to -- DuPont Lycra® spandex --

Signed and Sealed this

Twenty-first Day of June, 1994

*Attest:*

Bruce Lehman

BRUCE LEHMAN

*Attesting Officer*

*Commissioner of Patents and Trademarks*